United States Patent [19]

Willius

[11] Patent Number: 4,898,406

[45] Date of Patent: Feb. 6, 1990

[54] METHOD FOR HANGING BOOKS AND BOOK-LIKE ITEMS

[76] Inventor: Jeffrey D. Willius, 2322 Como Ave., St. Paul, Minn. 55108

[21] Appl. No.: 193,944

[22] Filed: May 13, 1988

[51] Int. Cl.[4] ..... B42D 17/00; B42F 15/00

[52] U.S. Cl. ..... 281/43; 160/348; 24/363; 24/230.5 W; 281/21.1; 281/51

[58] Field of Search ..... 281/15 R, 15 A, 15 B, 281/21, 43, 44, 21.1, 51; 160/348; 24/363, 230.5 W

[56] References Cited

U.S. PATENT DOCUMENTS

| | | | |
|---|---|---|---|
| 439,643 | 11/1890 | Fine | 281/15 A |
| 647,143 | 4/1900 | Marshall . | |
| 869,379 | 10/1907 | Mills . | |
| 1,034,221 | 7/1912 | Dutton . | |
| 1,133,655 | 3/1915 | Morgan | 281/15 A |
| 1,285,939 | 11/1918 | Cherry | 281/15 A X |
| 1,965,091 | 7/1934 | Wintrob | 160/344 |
| 1,999,583 | 4/1935 | Bouvier | 281/42 |
| 2,115,593 | 4/1938 | Strube | 24/363 X |
| 2,125,202 | 7/1938 | Sauer | 24/363 X |
| 2,278,143 | 3/1942 | Mathews | 281/42 |
| 2,983,415 | 5/1961 | Cooley | 224/45 |
| 3,174,626 | 3/1965 | West | 211/42 |
| 3,997,944 | 12/1976 | Phillips | 24/363 |
| 4,132,501 | 1/1979 | Simpson | 281/15 A |
| 4,152,013 | 5/1979 | Azzato | 281/15 A |
| 4,293,301 | 6/1890 | Brown . | |
| 4,306,736 | 12/1981 | Cournover et al. | 281/15 A |
| 4,418,825 | 12/1983 | Mahowald | 211/42 |
| 4,579,262 | 4/1986 | Keenan et al. | 223/88 |

*Primary Examiner*—Paul A. Bell

*Attorney, Agent, or Firm*—Merchant & Gould

[57] ABSTRACT

A hanger (10) slides into a book, gripping it securely with a spring tension and a receptacle bar (26) slanted so as to cause each book hung therefrom to slide by force of gravity to the bar's lowest point.

5 Claims, 2 Drawing Sheets

METHOD FOR HANGING BOOKS AND BOOK-LIKE ITEMS

Technical Field of the Invention

This invention relates to organizing or space-saving devices, specifically an improved means of storage and accessibility for books and other book-like publications and documents.

BACKGROUND OF THE INVENTION

Many types of books kept in the home and office are cumbersome or difficult to store efficiently and, as a result, occupy an inordinate amount of space. This is especially true for large, softcover books, such as telephone directories, magazines, instruction manuals and the like, which cannot support themselves when stood on end. The problem also affects any books used in an area where shelf space for conventional vertical storage is unavailable. Typically, such books have been stored horizontally, occupying a quantity of shelf or drawer surface area equal to the product of their two greatest dimensions. When kept in this position, books are subject to damage, soilage and wear. They become unsightly. In addition, they are likely to be covered with other books and papers and thus become difficult to locate.

Heretofore, many devices have been proposed for improved storage of books. Some devices (U.S. Pat. No. 429,301 to Brown, 1890 June 3 and U.S. Pat. No. 4,132,501 to Simpson, 1979 Jan. 2, for example), involve hanging the book by a corner. This type of solution has been found lacking in several ways. First, cornerhanging places the book in an oblique orientation, failing to use the normally rectangular nature of available storage volume in the most efficient manner. Corner-hanging also has esthetic shortcomings. Because the pages are aligned diagonally to the force of gravity, this orientation causes the pages of the stored book to spread apart at the corners and appear ungainly.

Some other devices (U.S. Pat. No. 869,379 to Mills, and U.S. Pat. No. 1,034,221 to Dutton, for example), hang the book with its spine horizontal, but must employ two or more points of support. Thus, the user faces several steps to install the device and the book suffers from two or more penetrations of its surfaces or form. Also, such overcomplicated hanging systems require unnecessary quantities of time and/or materials to manufacture.

Much of the prior art requires modification of the book in some way before the device can be used. U.S. Pat. No. 869,379, for example, requires that holes be drilled through the entire book. U.S. Pat. No. 4,418,825 to Mahowald, calls for a slot to be cut through the binding. This kind of solution not only requires tools, but demands considerable time from the user. It thus denies the convenience and timesaving purposes for which it was intended.

Even some solutions requiring no tools for installation still call for penetration of the cover, pages or spine of the book. U.S. Pat. No. 4,132,501, for example, calls for driving a sharp metal point through the spine.

Another critical drawback of some prior art is its obtrusiveness when the book is opened for use. U.S. Pat. No. 1,034,221 and U.S. Pat. No. 3,174,626 to West, for example, both extend so far beyond the spine as to interfere with the opening of the book.

U.S. Pats. No. 3,174,626 and No. 4,418,825, in addition to excessive extension, are made of sharp-edged, die-stamped metal, and thus can easily damage furniture or countertops when the book is placed spine down on such surfaces and moved during use.

Several previous patents require either some structural qualities of the book to be hung, or addition of a separate structural element as a part of the device. U.S. Pat. No. 4,418,825 requires a book with a rigid spine in order to accommodate the embedded hanger. This case is an ironic twist to the stated purpose of the device, with the book having to support the device.

Most prior art defies the adage which cautions against "complex solutions to simple problems". U.S. Pat. 4,306,736 to Cournover et al., in particular, and to some degree all of the prior art sighted herein, require either multiple parts, joining the elements by bolts, rivets or welding, complex forming or machining, expensive die-stamping or inordinate amounts of materials for manufacture. Such complexity adds to both producer and consumer cost without a concomitant enhancement of utility.

The prior art bearing the closest resemblance to the invention is a device used in a completely different field. A small plastic hanger of approximately the same shape as the invention is used to merchandise stockings. Besides its application to an unrelated item, the invention is fundamentally different from the stocking hanger in that it remains with the item it hangs while the item is used, whereas the stocking hanger is incidental to the use of the stockings and is discarded.

SUMMARY OF THE INVENTION

The present invention provides apparatus for hanging a book comprising a hanger and receptacle means. The hanger includes insert means for insertion in the book between the pages thereof, with the insert means including a first end to be inserted in the book and a second opposite end. The hanger further includes hook means for connection to the receptacle means and connecting means for connecting the hook means to the second end of said insert means so that when the insert means is inserted in said book and said hook means is connected to said receptacle means, the book hangs on said insert means. According to another aspect of the invention, the receptacle means comprises a bar, and the hook means comprises a curved hook member for hanging on the bar. According to yet another aspect of the invention, the means for connecting said second end of said insert means to said hook means includes means for pressing on the outside of the binding of said book to pinch said book binding against said insert means and thereby grip said book. According to still another aspect of the invention, the insert means, means for connecting end said hook means are constructed of a single unitary body.

According a more specific embodiment of the invention, there is provided a hanger formed from an elongate member, with the member having a substantially 180° bend therein to form a first span and second span on either side of the bend. The first span is straight and sized to slide in between the pages of a book proximate the binding of the book so that the second span is positioned on the outside of the binding of the book. The end of the second span has a hook formed therein. The apparatus of this embodiment of the invention further includes receptacle means for hanging said hook on whereby a book may be hung a hanger and hung on said receptacle means.

DETAILED DESCRIPTION OF THE DRAWINGS

Figure 1:
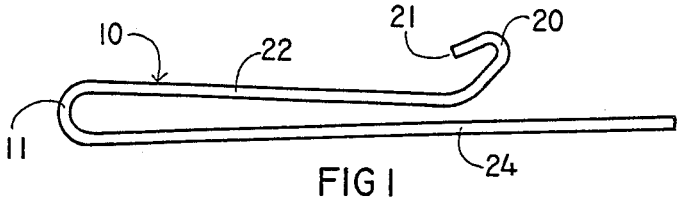
FIG. 1 is a front elevational view of the presently preferred embodiment of my invention showing the hanger part.

The invention comprises two main pieces a hanger 10 and a receptacle bar 26, which are shown in FIGS. 1–8. The hanger 10 is essentially a modified "S" curve formed by bending a length of heavy, round steel wire or bar stock to the shape shown in FIG. 1. Hanger 10 includes a bend 11 of slightly more than 180° to form a first short span 22 and a long book insert span 24. A hanging hook 20 is formed on the end of span 22 in such a way that the surface plane of its tip 21 is at approximately a 70° angle with respect to the long span 24. Thus, span 22 connects span 24 to hook 20. This configuration allows the hook to most easily pass over and hold the receptacle bar when the user hangs the book on receptacle bar 26. The short span 22 and the long span 24 are slightly inclined toward each other so that the distance between the two decreases toward the center of the hanger. This configuration allows for a tensionspring effect which secures the spine of the hanger in place pinching the binding 31 of the book 29 it is inserted in. The user inserts the hanger by opening the book to approximately its center spread and sliding the long span 24 between the pages proximate the spine of the binding 31. At the same time, the short span 22 and hook 20 slide longitudinally along the outside of the book spine until insertion is complete. The user can then use the book normally. When finished, he can close the book and, grasping it by one end, hang it by engaging hook 20 with receptacle bar 26.

Figure 2:
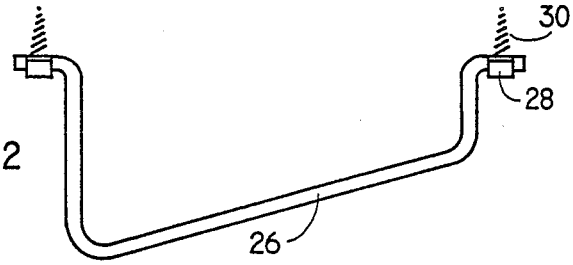
FIG. 2 is a front elevational view of the presently preferred embodiment of my invention showing the under-cabinet-mounted receptacle bar part.
Figure 3:
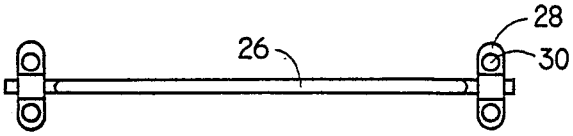
FIG. 3 is a bottom plan view of the under-cabinet-mounted receptacle bar part.
Figure 4:
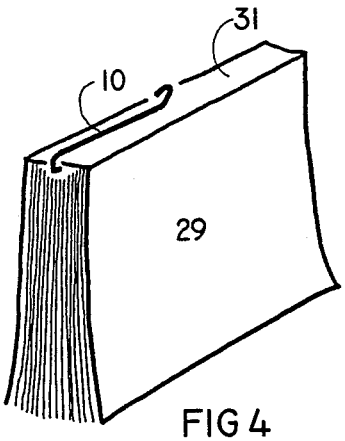
FIG. 4 is an isometric view showing the hanger inserted in a book, ready for hanging.
Figure 5:
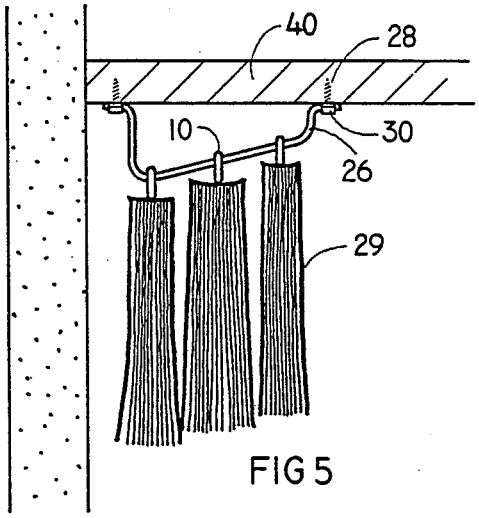
FIG. 5 is an end elevational view showing three units of my invention employed in hanging books from the under-cabinet-mounted receptacle bar.

The under-cabinet-mounted receptacle bar 26 is preferably made of the same material as the hanger, formed and mounted as shown in FIGS. 2, 3, and 5. The user mounts the bar underneath a shelf, cabinet, desk, table or other surface 40 using mounting brackets 28 and screws 30. This receptacle bar is formed in such a way that when it is mounted, its longest span is inclined at approximately 15° with respect to the horizontal of the surface 40 to which it is mounted. Thus, each book hung on it automatically slides by force of gravity to the bar's lowest point. This makes room for other books and keeps multiple books together for an efficient use of space and a neat appearance.

Figure 6:
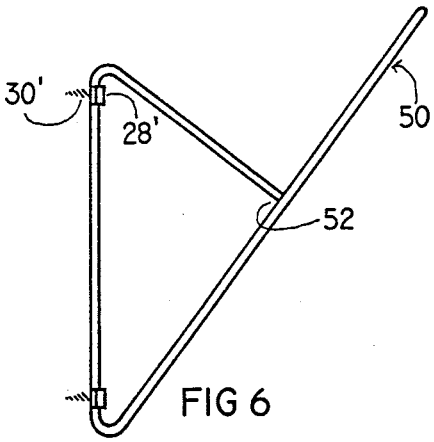
FIG. 6 is a side-elevational view of the presently preferred embodiment of my invention showing the wall-mounted receptacle bar.
Figure 7:
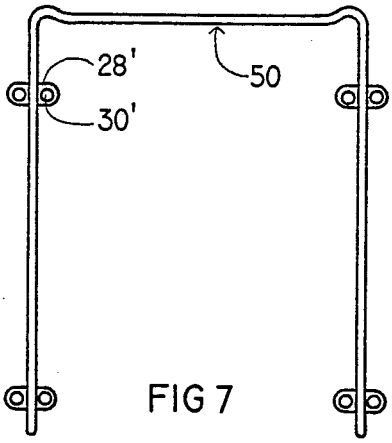
FIG 7 is a front elevational view of the wall mounted receptacle bar.
Figure 8:
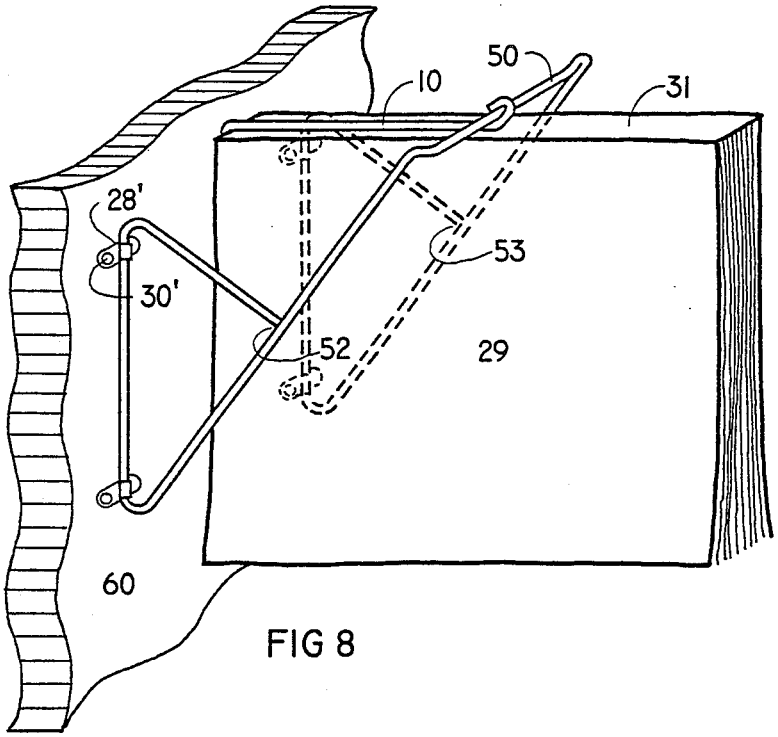
FIG. 8 is an isometric view showing my invention employed in hanging a book from the wall-mounted receptacle bar.

A wall-mounted receptacle bar 50 is shown in FIGS. 6, 7 and 8. It is made of the same material as the hanger 10. The user can mount bar 50 on any wall, partition or other vertical surface 60 using mounting brackets 28' and screws 30'. This receptacle bar is made of one continuous length of wire with two welds 52 and 53. It is designed so that the structural triangulation centers aesthetically within the dimensions of the hanging books. The actual hanging bar is sloped slightly upward at each end to prevent books from accidentally sliding off.

Hanger 10 and receptacle bars 26 and 50 are preferably finished with either enamel or epoxy. The coatings have a low coefficient of friction so that the surface of the hanger can slide easily on the pages of the book.

While the above description contains many specificities, these should not be construed as limitations on the scope of the invention, but rather as an exemplification of one preferred embodiment thereof. Many other variations are possible. For example, the size and/or proportions can be altered to present a different appearance. The invention can be made of different materials such as plastics, fiberglass, ceramics or metals other than steel. It can be coated in various ways with plastics, rubber, teflon etc. The cross-sectional shape of the form can be altered in many ways, some of which may enhance the structural properties, reduce materials, etc. The hook portion alone can take many forms and could even employ alternative holding principles such as Velcro, magnetics, etc. A collapsible or "pop-up" hook can be provided. The long span can be altered in length or with any number of extensions, bends, caps etc. to better hold specific types of books. A variation allowing the invention to be built into books during their manufacture can be made.

Many different hanging methods are envisioned besides that described in the preferred embodiment. Variations in the receptacle bar configuration can allow the user to hang books singly or in quantity and in virtually any manner including the wall-mounted version, a free-standing floor or countertop version and even a version suspended from a ceiling. Another alternative is a version which would allow a book to be rotated and opened for use without disengaging the hanger from its point of suspension. Applications to book-like items can be made; for example, by the hanging of documents or sheet material of any kind or size. Accordingly, the reader is requested to determine the scope of the invention by the appended claims and their legal equivalents, and not by the examples which have been given.

Thus, the present invention provides a neat, convenient and economical means to store and make readily accessible various types of books and book-like items. The items are stored in such a way as to eliminate use of valuable surface area. A book is supported in an orientation parallel to, rather than diagonal to, surrounding surfaces in order to make the most efficient use of the storage volume available. The invention further allows a book to be hung in a level position using only one point of attachment to the book thus simplifying production, installation and use. The invention further permits installation and use without modification of the book itself, including penetration of the spine or any continuous surface, or permanent adhesion or attachment of any kind. The invention also provides a means of securing the hanger to the book using properties integral to the form of the hanger itself, rather than alteration of the book—specifically a spring tension effect which grips the book's spine, thus holding the hanger in place.

What is claimed is:

1. A method for hanging a book having a spine of a certain length comprising the steps of:

(a) providing a hanger comprising an elongate member having a substantially 180° turn therein to form a first span and a second span on either side of said turn with the end of said second span having book means formed therein, said second span having a length approximately one-half said certain length of the spine, said first span being straight and sized to slide in between the pages of the book and having a length sufficient to support the spine of the book when it is suspended using said hanger, said turn in said hanger providing that said first and second spans pinch the spine of the book to keep the hanger member engaged therewith when said hanger is inserted in the book;

(b) inserting said hanger into the book so that said first span is inside the book on one side of the spine and said second span is on the outside of the book on the other side of the spine and so that said hook means is positioned approximately half-way between the ends of the spine;

(c) providing receptacle means for receiving and coupling with said hook means;

(d) securing said receptacle means to a support member such as a wall or a shelf; and (e) coupling said hook means of the inserted hanger to the mounted receptacle means so that the book hangs from the mounted receptacle means with the spine in a generally horizontal position.

2. A method according to claim 1 wherein said receptacle means includes a hanger bar.

3. A method according to claims 1 or 2 wherein at least said first span is coated with a material having a co-efficient of friction low enough to provide that said first span slides on the paper of said book without tearing it.

4. A method according to claim 1 further wherein said member is metal and wherein said turn is formed by a bend in said metal.

5. A method for hanging a book having a spine of a certain length comprising the steps of:

(a) providing a hanger formed from a length of heavy, steel wire or bar stock, said length bent in a modified "S" curve shape to form a first straight span and a second span on either side of said bend with the end of said second span having hook means formed therein, said second having a length approximately one-half said certain length of the spine, said first span sized to slide in between the pages of the book and having a length sufficient to support the spine of the book when it is suspended using said hanger, said bend in said hanger providing that said first and second spans pinch the spine of the book to keep the hanger member engaged therewith when said hanger is inserted in the book;

(b) inserting said hanger into the book so that said first span is inside the book on one side of the spine and said second span is on the outside of the book on the other side of the spine and so that said hook means is positioned approximately half-way between the ends of the spine;

(c) providing receptacle means for receiving and coupling with said hook means; and (d) coupling said hook means of the inserted hanger to the mounted receptacle means so that the book hangs from the mounted receptacle means with the spine in a generally horizontal position.

* * * * *

UNITED STATES PATENT AND TRADEMARK OFFICE

CERTIFICATE OF CORRECTION

PATENT NO. : 4,898,406

DATED : Feb. 6, 1990

INVENTOR(S) : Jeffrey D. Willius

It is certified that error appears in the above-identified patent and that said Letters Patent is hereby corrected as shown below:

col. 1, line 33-34, change "cornerhanging" to --corner-hanging--.

col. 3, line 1, after "hung" (1st occurrance), insert --on--.

col. 3, line 29,change "pieces" to --pieces:--.

col. 3, line 46, change "tensionspring" to --tension-spring--.
col. 3, line 46, delete "spine of the".

col. 3, line 47, after "the" (1st occurance) insert --spine of the--.

col. 5, line 11, change "book" to --hook--.

Signed and Sealed this

Twenty-sixth Day of February, 1991

*Attest:*

HARRY F. MANBECK, JR.

*Attesting Officer*

*Commissioner of Patents and Trademarks*